US005534205A

United States Patent [19]

Faley et al.

[11] Patent Number: 5,534,205

[45] Date of Patent: Jul. 9, 1996

[54] METHOD FOR PREPARING POLYBENZOXAZOLE OR POLYBENZOTHIAZOLE FIBERS

[75] Inventors: Timothy L. Faley; Michael E. Mills, both of Midland, Mich.; Yoshihiko Teramoto, Ohtsu, Japan; Douglas E. Turek, Midland, Mich.; Kazuyuki Yabuki, Ohtsu, Japan

[73] Assignee: The Dow Chemical Company, Midland, Mich.

[21] Appl. No.: 286,297

[22] Filed: Aug. 5, 1994

[51] Int. Cl.[6] ..... D01D 5/16; D01F 6/74

[52] U.S. Cl. ..... 264/103; 264/203; 264/178 F; 264/210.2; 264/210.7; 264/210.8; 264/211.12; 264/211.14; 264/211.16

[58] Field of Search ..... 264/103, 184, 264/203, 178 F, 210.2, 210.7, 210.8, 211.12, 211.14, 211.15, 211.16

[56] References Cited

U.S. PATENT DOCUMENTS

| | | | |
|---|---|---|---|
| 5,174,940 | 12/1992 | Kumar et al. | 264/184 |
| 5,234,651 | 8/1993 | Kawai | 264/184 |
| 5,286,833 | 2/1994 | Bubeck et al. | 528/183 |
| 5,288,445 | 2/1994 | Tani et al. | 264/85 |
| 5,294,390 | 3/1994 | Rosenberg et al. | 264/103 |
| 5,296,185 | 3/1994 | Chau et al. | 264/205 |
| 5,356,584 | 10/1994 | Bubeck et al. | 264/205 |

OTHER PUBLICATIONS

Ledbetter et al., An Integrated Laboratory Process For Preparing Rigid Fibers From The Monomers, pp. 253–264, 1989 Materials Research Society.

*Primary Examiner*—Leo B. Tentoni

[57] ABSTRACT

In a process for preparing polybenzoxazole or polybenzothiazole filaments by extruding a polybenzoxazole or polybenzothiazole dope, drawing the dope filament across an air gap, and coagulating the dope filament; the number of filament breaks can be reduced by placing a stress isolation device after extruding but before coagulating the filament.

11 Claims, 2 Drawing Sheets

METHOD FOR PREPARING POLYBENZOXAZOLE OR POLYBENZOTHIAZOLE FIBERS

BACKGROUND OF THE INVENTION

The present invention relates to a process for the preparation of polybenzoxazole or polybenzothiazole filaments and fibers.

In a typical process for preparing filaments or fibers of lyotropic liquid crystalline polybenzoxazole ("PBO") and polybenzothiazole ("PBT"), a dope of PBO or PBT polymer and an acid solvent is extruded through one or more orifices in a spinneret to form one or more dope filaments. The dope filaments are stretched or drawn to reduce the diameter of the filaments to a desired thickness. They are also coagulated by contacting them with a liquid which dilutes the solvent and is a non-solvent for the polymer. When multiple filaments are formed, they may be combined into one or more fibers either during or after coagulation. For obvious reasons, it is desirable to move the filaments or fibers through the process at speeds which maximize production, i.e., optimize line speed.

However, when a filament breaks prior to being combined to form a filament bundle or fiber, the process is disrupted until the line can be restrung. This is a time consuming operation which causes a loss of productivity. It is known that, in general, the faster the filaments or fibers move through the process (i.e., the higher the line speed), the more likely that filament breaks will occur. Slowing the line speed down makes line breaks less likely to occur, but decreases productivity accordingly.

It remains desirable to decrease the number of filament breaks at any line speed or increase the line speed without causing an unacceptable increase in the number of filament breaks.

SUMMARY OF THE INVENTION

Accordingly, the present invention is a process for preparing a polybenzoxazole or polybenzothiazole filament, said process comprising the sequential steps of extruding a polybenzoxazole or polybenzothiazole dope filament; drawing the dope filament while in an air gap; contacting the dope filaments with a stress isolation device while the filaments reside in the air gap; and coagulating the dope filaments.

It has been found that the dope filaments or fibers may be handled prior to coagulation. By inserting a stress isolation device before coagulation, PBO and PBT filaments and fibers can be effectively prepared. The process reduces the number of filament breaks at a given line speed and also allows the line speed to be increased without an unacceptable increase in the number of filament or fiber breaks.

DESCRIPTION OF THE DRAWINGS

Understanding the invention will be facilitated by referring to the accompanying drawings in FIGS. 1 and 2, which are schematic representations of one embodiment of the process of the present invention.

DETAILED DESCRIPTION OF THE INVENTION

Figure 2:
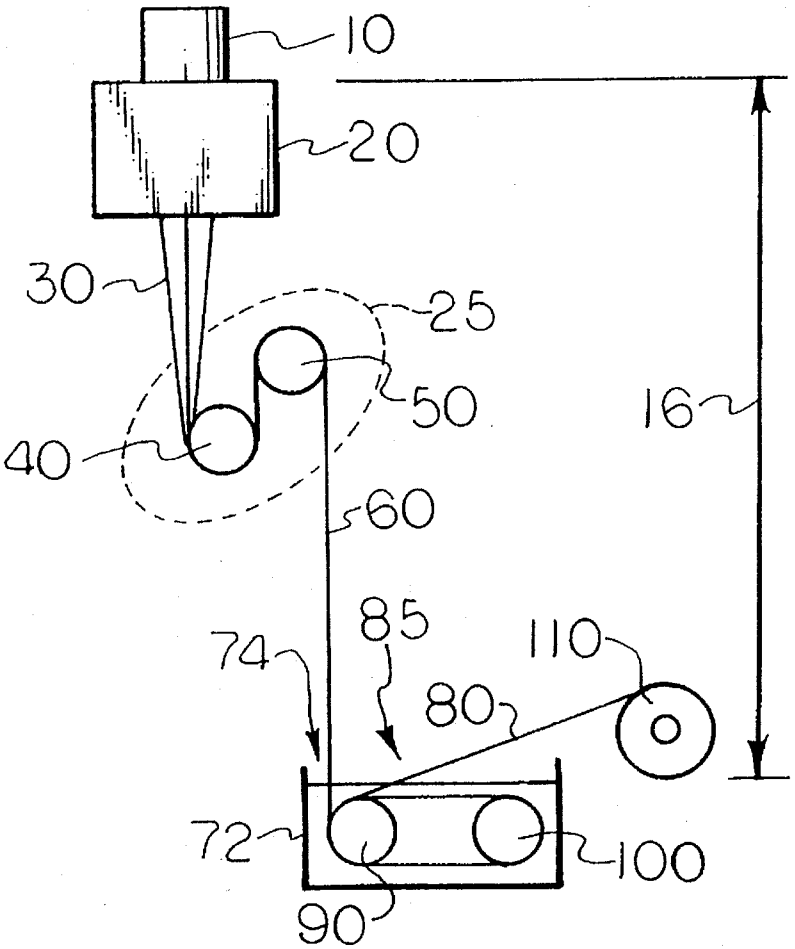
Figure 1:
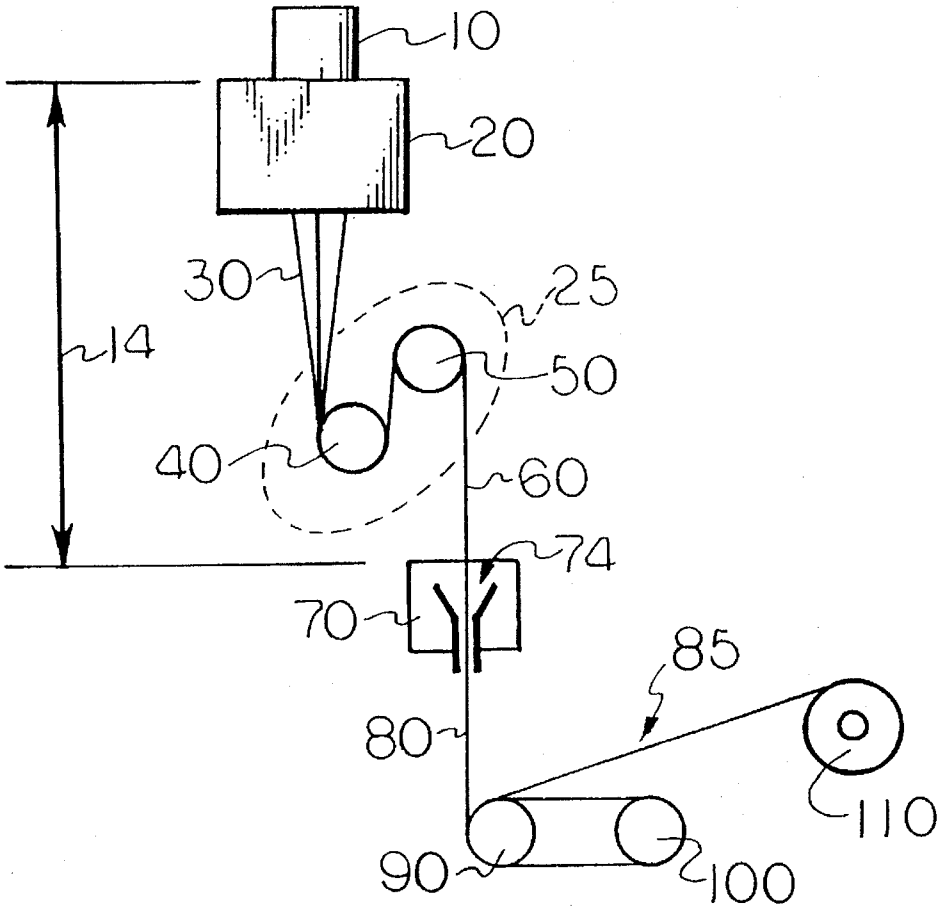

Referring now more particularly to the embodiments depicted in FIGS. 1 and 2, PBO or PBT dope is extruded through the orifice(s), one dope filament per orifice, of a spinneret 10 to form dope filaments 30; illustrated as three separate dope filaments in the drawings. When more than one dope filament is formed, the dope filaments 30 can be combined into a multi-filament fiber during the process (depicted in the illustrated embodiment as fiber 60).

The dope filaments 30 exiting spinneret 10 enter an area or "gap" 14 in FIG. 1 and 16 in FIG. 2 between spinneret 10 and the point at which the filament is contacted with a coagulating fluid 74. This gap is typically called an "air gap" although it need not contain air and may contain any gas that does not induce coagulation or react adversely with the dope such as air, nitrogen, argon, helium or carbon dioxide.

The air gap extends from the spinneret to the point where the dope filaments are coagulated. The maximum length of the air gap is limited, theoretically, by the breaking strength of the dope filaments and the force created by the filaments' own weight. For typical PBO or PBT spinning, the minimum clearance is about 5 cm plus whatever space is needed for the stress isolation devices; and, if employed in the air gap, whatever additional space is needed for the drawing implements. In general, the maximum length of the air gap is preferably less than about 100, more preferably less than about 10, and most preferably less than about 5, meters.

In the embodiments depicted by the figures, the air gap comprises a quench chamber 20 which partially encloses the filaments as they leave the spinneret 10. While the quench chamber 20 is optional, it is preferably employed to expose the dope filaments to a relatively constant atmosphere upon initial extrusion from the spinneret 10 such as by the flow of inert gas across the filaments to maintain a temperature from about 0° C. to about 100° C. in the quench chamber. Once the filament leaves the quench chamber, it can be exposed to atmospheric conditions until it is coagulated.

The dope filaments are stretched in the air gap to reduce the diameter of the filaments to the desired thickness and to orient the polymer. While it is possible to draw the filaments after they are bundled into a fiber, in general, most or all of the drawing is completed before the filaments are formed into a bundle either in a one-step or a multi-step process. However, it is possible to draw the individual filaments, bundle them into a fiber and subsequently draw the filaments in the fiber in an additional, yet generally lesser, amount. Regardless of how the filaments are drawn, essentially all of the filament stretching takes place in the air gap, regardless of where the drawing implements are located. Once coagulated, the filaments are not easily stretched. As such, the filament while in the air gap, reaches a line speed (i.e., terminal speed) that will be maintained throughout the coagulation process. Preferably, the spin-draw ratio, defined as the take-up speed to the extrusion speed, is at least about 10, more preferably at least about 20, most preferably at least about 40. Methods for spinning PBT and PBO are well-known in the art and reference is made to U.S. Pat. No. 5,296,185 which is hereby incorporated by reference and pending U.S. patent application Ser. No. 207,989, filed Mar. 8, 1994.

Also located within air gaps 14 and 16 in FIGS. 1 and 2, respectively, is a stress isolation device 25 which comprises, in the depicted embodiments, a pair of undriven rolls 40 and 50. In the depicted embodiments, the individual filaments are bundled to form fiber 60. After passing over rolls 40 and 50, dope fiber 60 is contacted with a non-solvent for the polymer. In the embodiment depicted in FIG. 1, the dope fiber 60 contacts coagulating liquid 74 in coagulation funnel 70. Coagulated fiber 80 then travels over drawing implement 85, in this embodiment, illustrated by driven rolls 90 and 100, which draws the filaments. The fiber is then wound on winder 110. In the embodiment depicted in FIG. 2, fiber 60 passes through a coagulation bath 72 containing the coagulation liquid 74 and over driven rolls 90 and 100 which draws the filaments and then is wound on winder 110.

Figure 3:
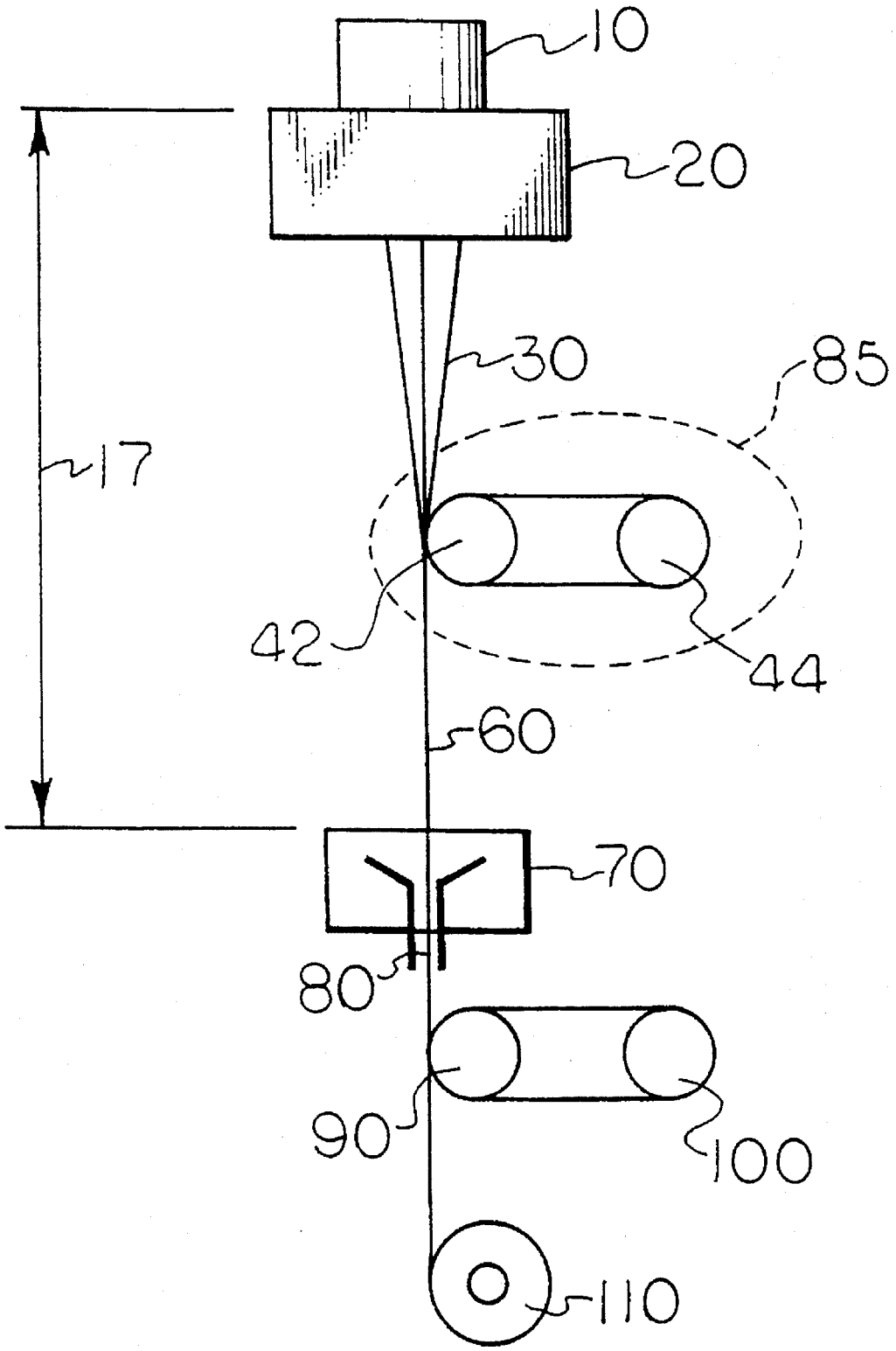
FIG. 3 is a schematic representation of a second embodiment of the process of the present invention.

In the embodiment depicted in FIG. 3, the dope is extruded through the orifice(s) of spinneret 10, one dope filament per orifice, to form dope filaments 30 which are then combined into a multi-filament fiber 60. The fiber 60 is passed over drawing implement 85 which in the illustrated embodiment comprises a pair of driven rolls 42 and 44. Drawing implement 85 draws and stretches the filaments 30 from the spinneret to orient the polymer and reduce their diameter to the desired thickness. Driven rolls 42 and 44 also act as the stress isolating device. Fiber 60 then passes through coagulating funnel 70 containing coagulating fluid 74. The coagulated fiber 80 travels over driven rolls 90 and 100 and is wound onto winder 110.

While not intending to be bound by theory, it is believed that by inserting a stress isolation device between the extrusion and coagulation of the dope, any turbulence or other instability caused by the contact of the dope filaments or fiber bundle with the coagulating fluid is isolated from the drawing of the individual filaments; thereby reducing filament breaks during the drawing operation. Without the stress isolation device being used, the instability in the process leading to filament breakage of the fiber was compensated by decreasing the line speed to improve long-term spinning stability. With the stress isolation device, it is possible to maintain the same line speed with improved stability (i.e., less filament breaks) or to increase the line speed without causing an unacceptable increase in the number of breaks. While an unacceptable number of breaks will depend on a number of factors including the specific drawing process and dope being extruded, in general, it is preferred that there is less than 4, more preferably less than about 2, most preferably less than about 1, break per each two-day period of continuous spinning.

With regard to the various components and process steps in the illustrated embodiments, the stress isolating device can be any device that acts upon the dope filament to reduce the migration of turbulence or instability of the process which causes filament breaks. In general, the stress isolation device reduces the magnitude of the downstream turbulence the dope filament experiences when contacting the coagulating fluid, from being conveyed up the line to the point where the filament leaves the spinneret. Any device which is capable of performing this function can be employed as the stress isolation device.

Examples of effective stress isolation devices include: solid, non-rotating guides (as shown on page 74 of the Dictionary of Fiber & Textile Technology, 1990 by Hoechst Celanese Corporation); shoes; single rolls; undriven or driven rolls; and matched pairs of undriven and driven rolls. Driven rolls used as stress isolation devices can also serve the function of the drawing implement. An adequate material of construction for the stress isolation device is solid, acid-resistant metal or ceramics, or a coating of acid-resistant metal or ceramics over a suitable substrate. In general, the stress isolation device can be placed at any point between the extrusion and coagulation operations, with the most preferred location being dependent on a number of factors including the specific stress isolation device employed, the line speed, the conditions at which the filaments are being drawn, and the specific dope being extruded. In general, the stress isolation device is preferably located after or coincident with the attainment of the final filament speed (i.e., drawing is essentially complete). The optimal position for the stress isolation device can easily be achieved by moving the device between extrusion and coagulation until the optimal balance of filament breaks and line speed is obtained.

The drawing implement can be any device which causes the filament to stretch after being extruded. In general, the drawing implement stretches the filament to reduce its diameter to a desired thickness and to orient the polymer. The amount of stretching is chosen such that the finished fiber or filament has the desired size and physical properties and any implement which causes the proper amount of stretching or drawing can be employed. Examples of effective drawing implements and isolation devices include driven rolls made of a material sufficiently resistant to endure repetitive contact with the very strong acids present in the dope filament such as used for the stress isolation device. When more than one pair of driven rolls is used in the process, it is possible to draw the filaments in more than one step, i.e., a multi-step drawing process. For example, two sets of driven rolls may be employed. In this case, the first set of rolls will operate at one speed to draw or stretch the filaments following extrusion, whereas the second set of rolls will operate at a second and higher speed to further draw or stretch the filaments. The second set of rolls may be placed either before or after the filaments have been bundled into a fiber. In general, the drawing implement(s) can be placed at any suitable location in the process, (including as illustrated in FIG. 1) after coagulation, or (as illustrated in FIG. 2) in the coagulation bath. The location and specific drawing implement most advantageously employed is based on a number of factors including the amount of drawing desired and the specific drawing implement(s) employed.

The spinneret is chosen to prepare filaments of a desired number and size. In the practice of this invention, the desired number of filaments spun is from about 50 to about 1500 , preferably from about 100 to 1000 , more preferably from about 150 to 750; PBT or PBO filaments are extruded through a single spinneret. These filaments are generally prepared at from about 1 to about 3, preferably from about 1 to about 2.5, and more preferably at about 1.5 denier per filament and the spinneret selected accordingly. In general, the filaments are combined or bundled into a fiber having a denier of at least about 50, preferably at least about 350, and more preferably at least about 400 and a denier less than about 5000, preferably less than about 4500, and more preferably less than about 2500. Most preferably, the fiber has a denier of about 500, about 1000 or about 2000 and the number of filaments and filament denier chosen accordingly. In general, the most preferred fibers are prepared from filaments having 1.5 denier per filament, with 166 filaments making a fiber of 250 denier; 333 filaments being bundled to make a fiber of 500 denier; 667 being bundled to make a 1000 denier fiber; and 1333 filaments being bundled to make a 2000 denier fiber. In general, to prepare these filaments, the orifices in the spinneret are from about 0.1 to about 0.5, preferably from 0.1 to about 0.3, and more preferably from 0.15 to about 0.25 millimeters in diameter; with orifice diameters of 0.18, 0.20 and 0.22 millimeters being most preferred.

The filaments are coagulated using a non-solvent for the polymer but which dilutes the solvent, thereby removing the dope solvent from the filament. Suitable liquids include water, and a mixture of water and polyphosphoric acid; with the preferred coagulating liquid being water. The coagulation can take place in any manner and using any equipment which provides suitable contact between the coagulating liquid and filament to effectively remove the dope solvent. In general, the coagulation can be conducted in a coagulating funnel or by running the fiber through a spray or bath. Methods of coagulation are well-known in the art and reference is made to U.S. Pat. Nos. 4,869,860 and 4,298,565; and U.S. patent application Ser. No. 08/110,149, all of which are incorporated herein by reference, for such techniques.

The coagulated and washed fiber is collected and dried using techniques well-known in the art. After drying, the fibers can be heat-treated to further increase their tensile modulus if desired. Reference is made to U.S. Pat. Nos. 5,288,452 and 5,288,445 as well as copending U.S. patent application Ser. Nos. 162,724 filed Dec. 3, 1993 and 142,526, filed Nov. 2, 1993, all of which are incorporated herein by reference, for methods of collecting, drying, and heat-treating the fibers.

The process for coagulating and washing fibers is conducted at line speeds which optimize production and the maximum line speed is limited by acceptable processing. In general, the terminal line or wind-up speed will normally not exceed about 10,000 meters per minute and will preferably be less than about 5,000; more preferably less than about 2,000 meters per minute. In general, the terminal line speed should exceed 200, preferably 400, and more preferably 600, meters per minute.

The dope used in preparing the PBO or PBT polymer is a solution of the polymer in a solvent. PBO, PBT and random, sequential and block copolymers of PBO and PBT are described in references such as Wolfe et al., *Liquid Crystalline Polymer Compositions Process and Products*, U.S. Pat. No. 4,703,103 (Oct. 27, 1987); Wolfe et al., *Liquid Crystalline Polymer Compositions, Process and Products*, U.S. Pat. No. 4,533,692 (Aug. 6, 1985); Wolfe et al., *Liquid Crystalline Poly*(2,6-Benzothiazole) *Compositions, Process and Products*, U.S. Pat. No. 4,533,724 (Aug. 6, 1985); Wolfe, *Liquid Crystalline Polymer Compositions, Process and Products*, U.S. Pat. No. 4,533,693 (Aug. 6, 1985); Evers, *Thermooxidatively Stable Articulated p-Benzobisoxazole and p-Benzobisthiazole Polymers*, U.S. Pat. No. 4,359,567 (Nov. 16, 1982); Sybert et al., U.S. Pat. No. 4,772,678 (Sep. 20, 1988); Harris, U.S. Pat. No. 4,847,350 (Jul. 11, 1989) and Tsai et al., *Method for Making Heterocyclic Block Copolymer*, U.S. Pat. No. 4,578,432 (Mar. 25, 1986), all of which are hereby incorporated by reference. PBO or PBT polymers can be advanced rapidly to high molecular weight at relatively high temperatures and high shear in a dehydrating solvent acid. See, for example, U.S. Pat. No. 5,089,591 to Gregory et al.

Units within the PBO or PBT polymer are preferably chosen so that the polymer is lyotropic liquid-crystalline. Preferred monomer units are illustrated in the formulae below. The polymer more preferably consists essentially of monomer units selected from those illustrated, and most preferably consists essentially of cis-polybenzoxazole, trans-polybenzoxazole, or trans-polybenzothiazole.

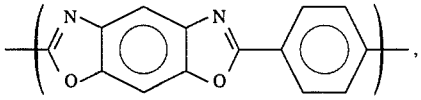

cis-polybenzoxazole

Poly[benzo(1,2-d:5,4-d')bisoxazole-2,6-diyl-1,4-phenylene]

-continued

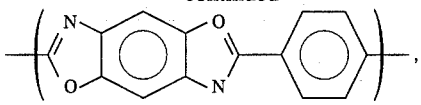

trans-polybenzoxazole

Poly[benzo(1,2-d:4,5-d')bisoxazole-2,6-diyl-1,4-phenylene]

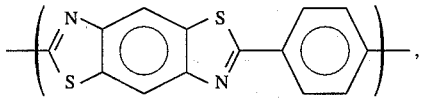

trans-polybenzothiazole

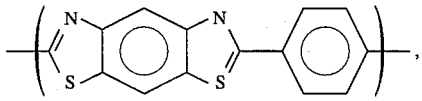

cis-polybenzothiazole

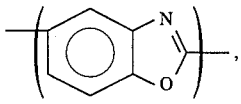

AB-PBO
Poly(2,5-benzoxazole)

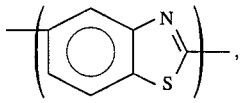

Poly(2,5-benzothiazole)

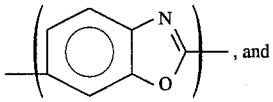

, and

AB-PBO
Poly(2,6-benzoxazole)

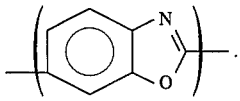

Poly(2,6-benzothiazole)

Solvents suitable for formation of dopes of PBO or PBT polymers include cresol as well as non-oxidizing acids capable of dissolving the polymer. Examples of suitable acid solvents include polyphosphoric acid, methanesulfonic acid, and highly concentrated sulfuric acid and mixtures of those acids. Preferred solvents are polyphosphoric acid and methanesulfonic acid. Most preferably, the solvent is polyphosphoric acid.

The dope is prepared at the desired concentration of solvent and polymer. While concentration of polymer and solvent can vary widely depending on a number of factors including the specific solvent and polymer employed and the desired properties of the solution, the dope is preferably prepared having at least about 7, more preferably at least about 10, and most preferably at least about 14, weight percent polymer. The maximum concentration is limited primarily by practical factors, such as polymer solubility and dope viscosity. The maximum concentration of polymer is usually no more than about 20 weight percent, more preferably less than about 18 percent polymer. Most preferably, a dope comprises about 14 weight percent polymer based on the total weight of the polymer and solvent.

EXAMPLES

The following examples are given to illustrate the invention and should not be construed as limiting its scope. Unless otherwise indicated, all parts and percentages are by weight.

EXAMPLE 1

Using an apparatus similar to that depicted in FIG. 1, a spinning dope which contains 14 percent of cis-polybenzazole (inherent viscosity of approximately 33, measured at 25° C., in a nearly saturated solution of methanesulfonic acid anhydride in methanesulfonic acid at a concentration of 0.046 g/dL) and 86 percent polyphosphoric acid is extruded from a spinneret having 42 orifices at 178° C. The diameter of each orifice at the exit point is 0.22 millimeters (mm), the velocity of PBO dope through each orifice is 3.2 meters/minute (m/min) and the PBO throughput/orifice is 0.24 grams/minute (g/min).

The filaments are drawn over a stress isolation device comprising an undriven roll located 142 centimeters (cm) from the spinneret and into a coagulation bath containing deionized water at room temperature located 282 cm from the spinneret; thereby making the air gap in this example about 282 cm. The velocity of the filaments as they enter the coagulation bath is 200 m/min. The filaments are combined into a fiber on the stress isolation device. A second (driven) roll, placed in the coagulation bath and operated at 200 m/min, is used to draw the filaments. After being coagulated, the filaments (or fiber) are washed, dried, and wound on a spool. The stability of this process corresponds to about 0.02 breaks per hour, which means the spinnability was rated excellent.

Comparative Example A

The spinning described in Example 1 was duplicated except that the fibers were not drawn over a stress isolation device but were immediately drawn from the spinneret through a coagulation funnel and then over an undriven roll at which time the filaments were formed into a fiber. The air gap in this setup was 43 cm. The stability of this process corresponds to about 0.04 breaks per hour which means the spinnability was rated only good.

The tensile strength, tensile modulus, and elongation of the PBO fibers made in Example 1 and Comparative Example A are tested and the results of these tests are set forth in Table I.

TABLE I

| Fiber Properties | Unit | Example 1 | Comparative Example A |
|---|---|---|---|
| Tensile Strength | GPa | 5.7 | 5.7 |
| Tensile Modulus | GPa | 201 | 201 |
| Elongation-to-Break | percent | 3 | 3 |

These results show that fiber having equivalent properties can be produced while maintaining the same line speed by inserting a stress isolation device in the air gap while realizing an improvement in the overall spinnability as measured by a decrease in the number of breaks per hour.

EXAMPLE 2

Using an apparatus such as depicted in FIG. 3, a spinning dope which contains 14 percent of cis-polybenzazole (inherent viscosity of approximately 27, measured at 25° C., in a nearly saturated solution of methanesulfonic acid anhydride in methanesulfonic acid at a concentration of 0.046 g/dL) and 86 percent polyphosphoric acid is extruded through 166 orifices in a spinneret at 170° C. Each orifice has a diameter of 0.18 mm, the throughput per orifice is 0.24 g/min and the total throughput is 39.5 g/min of dope; the shear rate is 3500 $sec^{-1}$. The extruded filaments are passed over a pair of driven rolls located 70 cm after the spinneret and then passed into a coagulation bath containing deionized water at room temperature and located about 142 cm beyond the spinneret. The line speed is 200 m/min and the spin-draw ratio 42. The coagulated fibers are washed, dried, and wound on a spool. The stability of this process corresponds to about 0.02 breaks per hour, which means the spinnability was rated excellent.

Comparative Example B

The process described in Example 2 was duplicated except that the filaments are not drawn over a stress isolation device but were immediately drawn from the spinneret through a coagulation funnel and then over a pair of driven rolls at which time the filaments were formed into a fiber. The air gap in this setup was thus 70 cm. The fibers were then washed, dried, and wound onto a spool. The stability corresponds to about 0.04 breaks per hour, which means the spinnability was rated only good.

EXAMPLE 3

A PBO fiber (designated Fiber 3) is prepared in an identical manner to Example 2 except that each orifice of the spinneret is 0.21 mm in diameter, the throughput per orifice is 0.48 g/min and the total throughput through the spinneret is 79 g/min. The line speed is maintained at 400 m/min and the spin-draw ratio at 58. The stability corresponds to about 0.04 breaks per hour which means the spinnability was rated good.

When compared to the process of Comparative Example B, the process according to this invention was found to give the same spinnability and breaks per hour even when operated at twice the speed. When compared to the process of Comparative Example C, the process according to this invention was found to give the better spinnability and less breaks when operated at the same speed.

Comparative Example C

The spinning described in Example 3 was duplicated except that the fibers were not drawn over a stress isolation device but were immediately drawn from the spinneret through a coagulation bath and then over a first pair of driven rolls at which time the filaments were formed into a fiber. The air gap in this setup was thus 70 cm. The fibers were then washed, dried, and wound onto a spool. The stability corresponds to about 0.08 breaks per hour which means the spinnability was rated poor.

The tensile strength, tensile modulus, and elongation to break of the PBO fibers made in Examples 2 and 3 and Comparative Examples B and C are tested and the results of these tests are set forth in Table II.

TABLE II

| Fiber Properties | Unit | Example 2 | Comp. Example B | Example 3 | Comp. Example C |
|---|---|---|---|---|---|
| Denier | g/9000 m | 250 | 250 | 250 | 250 |
| Individual Filament Denier | dpf | 1.5 | 1.5 | 1.5 | 1.5 |
| Tensile Strength | GPa | 5.7 | 5.5 | 5.8 | 5.6 |
| Elongation-to-Break | percent | 3.6 | 3.7 | 3.6 | 3.7 |
| Tensile Modulus | GPa | 159 | 156 | 166 | 160 |

EXAMPLE 4

A spinning dope containing 14 percent of cis-polybenzazole (inherent viscosity of approximately 30, measured at 25° C., in a nearly saturated solution of methanesulfonic acid anhydride in methanesulfonic acid at a concentration of 0.046 g/dL) and 86 percent polyphosphoric acid is extruded through 166 orifices in a spinneret at 170° C. The exit diameter of each orifice is 0.18 mm, the throughput of dope per orifice is 0.24 mL/min, and the shear rate of dope as it passes through each orifice is 3500 $sec^{-1}$. The extruded filaments are combined into a fiber which travels over a stress isolation device that consists of two pair of driven rolls. The fiber is then drawn through a coagulation bath. It is then washed, dried, and wound onto a spool. The distance between the spinneret and the first pair of driven rolls is 70 cm and the fiber is drawn over these rolls at about 180 m/min. The spin-draw ratio between the spinneret and this first set of rolls is 38.2. The second set of driven rolls is about 30 cm beyond the first set of rolls. The air gap is about 142 cm. The fiber is drawn over the second set of rolls at about 200 m/min. The spin-draw ratio between the first and second set of rolls is 1.1, making the total spin-draw ratio from both stages of drawing 42.

The stability of the process corresponded to about 0.04 breaks per hour, which means the spinnability was rated good.

EXAMPLE 5

Example 4 is repeated except the fiber is drawn over the first of the two pairs of driven rolls at 200 m/min and over the second pair of driven rolls at essentially the same speed of about 200 m/min. The spin-draw ratio of 42 is achieved in a single stage of drawing between the spinneret and the first pair of driven rolls as opposed to a multi-stage drawing operation as in Example 4.

The tensile strength, elongation to break and tensile modulus for the fibers prepared in Examples 4 and 5 are reported in Table III.

TABLE III

| Fiber Properties | unit | Example 4 | Example 5 |
|---|---|---|---|
| Denier | g/9000 m | 250 | 290 |
| Individual Filament Denier | dpf | 1.5 | 1.5 |
| Tensile Strength | GPa | 5.9 | 5.5 |
| Elongation-to-Break | % | 3.4 | 3.6 |
| Tensile Modulus | GPa | 171 | 159 |

This example illustrates a multi-stage drawing of uncoagulated filament(s)/fiber in the air gap and indicates that it can be employed to make a fiber having excellent physical properties.

What is claimed is:

1. A process for preparing a polybenzoxazole or polybenzothiazole filament, said process comprising the sequential steps of:

(a) extruding a polybenzoxazole or polybenzothiazole dope filament;

(b) drawing the dope filament while in an air gap;

(c) contacting the dope filament with a stress isolation device while the filament resides in the air gap; and (d) coagulating the dope filament.

2. The process of claim 1 in which polybenzoxazole or polybenzothiazole dope filaments are extruded through more than one orifice of a spinneret.

3. The process of claim 2 in which more than one dope filament is extruded and the filaments are combined to form a fiber either before, during or after the filaments are coagulated.

4. The process of claim 1 in which the stress isolation device also functions as a drawing implement that draws the filament.

5. The process of claim 1 in which the filaments are drawn in a multi-step drawing process.

6. The process of claim 1 wherein PBT and PBO filaments have a filament denier from about 1 to about 2.5 denier per filament.

7. The process of claim 6 wherein PBT and PBO filaments have a filament denier of 1.5 denier per filament.

8. The process of claim 3 wherein from about 100 to 3500 filaments are extruded.

9. The process of claim 8 wherein the filaments are combined or bundled into a fiber having a denier of from about 350 to about 5000.

10. The process of claim 9 wherein the fiber has a denier of about 500, about 1000 or about 2000.

11. The process of claim 1 wherein the terminal line speed is from about 600 to about 2000 meters per minute.

* * * * *